US005550519A

United States Patent [19]

Korpela

[11] Patent Number: 5,550,519

[45] Date of Patent: Aug. 27, 1996

[54] DIELECTRIC RESONATOR HAVING A FREQUENCY TUNING ELEMENT EXTENDING INTO THE RESONATOR HOLE

[75] Inventor: Juha Korpela, Kempele, Finland

[73] Assignee: LK-Products OY, Kempele, Finland

[21] Appl. No.: 373,859

[22] Filed: Jan. 18, 1995

[30] Foreign Application Priority Data

Jan. 18, 1994 [FI] Finland ..... 940246

[51] Int. Cl.[6] ..... H01P 1/202; H01P 7/04

[52] U.S. Cl. ..... 333/207; 333/224

[58] Field of Search ..... 333/202, 206, 333/222, 207, 223, 224

[56] References Cited

U.S. PATENT DOCUMENTS

| | | | |
|---|---|---|---|
| 4,506,241 | 3/1985 | Makimoto et al. | 333/222 |
| 4,523,162 | 6/1985 | Johnson | 333/202 |
| 4,631,506 | 12/1986 | Makimoto et al. | 333/224 |
| 4,757,284 | 7/1988 | Ueno | 333/206 X |
| 5,218,330 | 6/1993 | Omiya et al. | 333/223 |

FOREIGN PATENT DOCUMENTS

| | | | |
|---|---|---|---|
| 0508733 | 10/1992 | European Pat. Off. . | |
| 87852 | 2/1993 | Finland | H01P 1/201 |
| 1108824 | 6/1961 | Germany . | |
| 5919404 | 1/1984 | Japan | 333/207 |
| 0185403 | 3/1989 | Japan | 333/202 DB |
| 2236432 | 4/1991 | United Kingdom . | |

OTHER PUBLICATIONS

Patent Abstracts of Japan, vol. 8, No. 268 (E–283) [1705], Dec. 7, 1984 & JP–A–59 139701 (Nihon Dengiyou Kousaku K. K.) Aug. 10, 1984, 1 page, Hatanaka.

Patent Abstracts of Japan, vol. 17, No. 160 (E–1342), Mar. 29, 1993 & JP–A–04 323902 (Kyocera Corp.) Nov. 13, 1992, 1 page, Tetsuya.

*Primary Examiner*—Benny Lee
*Assistant Examiner*—Justin P. Bettendorf
*Attorney, Agent, or Firm*—Darby & Darby, P.C.

[57] ABSTRACT

The invention relates to a dielectric resonator comprising a block (2) of dielectric material, having upper (9), lower and side surfaces and in which there is a hole (3*a*) extending from the upper surface to the lower surface. The hole (3*a*) and the lower surface as well as at least part of the side surfaces are coated with an electrically conductive material and at least the upper surface (9) is uncoated so that the hole (3*a*) thus forms a transmission line resonator. The uncoated surfaces are covered with a lid (5) of an electrically conductive material, whereby the dielectric block is substantially surrounded by an electrically conductive material. The resonator hole (3*a*) is composed of two portions, a straight portion (3*a*) beginning from the lower surface of the dielectric block as well as a wider portion (10) that is formed above the straight portion and opens into the upper surface (9) of the dielectric block. Both portions are covered with an electrically conductive material and the coatings of both portions form a juncture. Formed above the resonator hole is a frequency tuning element (11), the first end of which is earthed, the other end being at a distance from the surface of the resonator hole, thus forming a capacitance between the earth plane and the upper end of the transmission line resonator.

9 Claims, 2 Drawing Sheets

DIELECTRIC RESONATOR HAVING A FREQUENCY TUNING ELEMENT EXTENDING INTO THE RESONATOR HOLE

BACKGROUND OF THE INVENTION

The present invention relates to a dielectric resonator comprising a block of dielectric material, having upper, lower and side surfaces and in which there is a hole extending from the upper surface to the lower surface, the hole and the lower surface as well as at least part of the side surfaces being coated with an electrically conductive material, at least the upper surface being uncoated and the hole forming a transmission line resonator, and the uncoated surfaces are covered with a lid of an electrically conductive material, whereby the dielectric block is substantially surrounded by an electrically conductive material.

It is known that a dielectric resonator, for example, a ceramic resonator, comprises, in its basic structure, a block of dielectric material, for example, titanate, having a high dielectric constant, in which block a hole is made and which has side surfaces, as well as upper and lower surfaces and the hole extends from the upper surface of the block to the lower surface. The surfaces of the block are, with the exception of the upper surface, coated with an electrically conductive material. The hole, too, is coated with an electrically conductive material. The hole is short-circuited at the juncture where the coating of the coated hole joins the coating of the lower surface. Because the upper surface is uncoated at least in the vicinity of the hole, the hole is open at this end. The construction forms a power line resonator whose resonance frequency is determined by the length of the hole, that is, by the thickness of the dielectric block. The resonance frequency is formed in accordance with the equation $$f_R = \frac{c}{\lambda\sqrt{\epsilon_r}}$$

in which $f_R$ is the resonance frequency in Hertz, c is the velocity of light, $\lambda$ is the wavelength in meters and $\epsilon_r$ is the relative dielectric constant of the dielectric material. Accordingly, the resonance frequency in megahertz is formed roughly in accordance with the equation $$f_R = \frac{300}{\lambda\sqrt{\epsilon_r}} .$$

Usually the length of the hole is dimensioned in such a way as to yield a transmission line resonator a quarter wave in length. When an electromagnetic wave is introduced into the construction, a standing wave is produced in the direction of the hole at a given frequency, that is, the resonance frequency. The maximum of its capacitive field is at the open end of the hole, whereas the maximum of the inductive field is at the short-circuited end of the hole. If various conducting patterns are disposed in the uncoated upper surface, it is possible to exercise an effect on both the resonance frequency of an individual resonator and on the coupling between the resonators if there are several resonators. When more than one hole is formed in the dielectric block, that is, there is more than one transmission line resonator in parallel, a dielectric filter can be implemented which has several zero or pole points. By placing a conductor spot beside the open end of the outermost resonators of the block and such that it is insulated from the coating of the side of the block, a signal can be brought to the resonator by coupling it capacitatively to the resonator and it can be directed outward from the resonator with the same capacitive coupling. Because there is a specified capacitance value between the coating of the open upper end of the resonator and the coating of the upper edge of the side of the dielectric block, this capacitance can be changed by adding a coating to the upper side near the hole, the coating thus constituting a juncture with the coating of the side, or by adding a coating to the upper side, thus forming a juncture with the coating of the hole. This offers a way of affecting the resonance frequency. It is furthermore possible to make use of conducting patterns so as also to arrange on the upper surface—between the resonators—capacitors and transmission lines and thus to affect the coupling between the resonators. The inductive coupling between the resonators can be affected by treating the dielectric block, for example, by boring holes in it or otherwise by removing material from it.

Disposing conducting patterns on the upper surface of the dielectric block is nevertheless very troublesome because the available surface area is very small, which means that even small imprecisions in positioning the conductor patterns will have a great effect on the electrical characteristics of the filter. In addition, by positioning the conducting patterns solely on the upper surface, it is possible only to affect the capacitive field and the couplings are thus capacitive.

A decisive improvement in this generally used method is disclosed in the present applicant's patent application EP-0 401 839, Turunen et al. In the filter described therein, the electrical characteristics of the filter can be affected in a wide range such that the side surface of the dielectric block is substantially uncoated and the conductor patterns and coupling wires are disposed in this side surface of the filter block. Apart from the fact that a much more extensive surface area is now available for positioning the conducting patterns than when they are positioned on the upper surface, it is also possible to affect the inductive coupling between the resonators. The inductive field is indeed at its greatest at the short-circuited lower end of the resonator. Positioning the conductor pattern on the side surface thus permits making the connection between the resonators capacitive, inductive and capacitive-inductive in the same filter block. A coupling to the filter can also be made inductive, capacitive or a combination of these. Small variations in the positioning of the conductor patterns to the side of the block are not as sensitive in affecting the electrical properties of the filter as is the case when the patterns are positioned on the upper surface with its small surface area. According to the EP application, the side in which the conducting patterns are located is finally covered with a metal lid. This filter construction permits the filter designer a great latitude of freedom and in practice, using only a few standard-sized filter blocks, different types of filters can be constructed by varying the bandwidth and the average frequency of the resonators, that is, by using different kinds of conducting patterns.

The dielectric block is usually of ceramic material, which is pressed into a form and it can be very precisely fabricated to the correct size. There is nevertheless a need to tune the resonance frequency of the resonator. Particularly when filters are being formed, it is common to tune the resonance frequencies of the different resonators of the filter to different magnitudes depending on the characteristics which the filter is expected to provide.

One method of tuning the frequency of the resonator is to increase the capacitance at the open upper end of the resonator. By increasing the capacitance of the open end of the resonator, its resonance frequency can be reduced, whereby the resonator hole can also be fabricated so that it is shorter, thereby enabling the dielectric filter to be smaller in size. This capacitance can be implemented by means of an electrode plate positioned above the open end of the resonator, the plate thus forming a capacitance with the open end of the resonator. This kind of tuning element for the resonance frequency, which is based on the use of an electrode plate, can be implemented, for example, by means of an electrode plate 6a, 6b disposed at the end of an adjusting screw 7a, 7b mounted in enclosure 5, which covers the open end of the resonator, as is shown in FIG. 1, whereby by means of adjusting screw 7a, 7b the capacitance, that is, the distance between electrode plate 6a, 6b and the open end of resonator 3a, 3b, can be tuned. Another alternative for implementing this kind of resonance frequency tuning element is to form in enclosure 5, which is of an electrically conductive material, above the open end of the resonator, bent tabs 8a, 8b, as is shown in FIG. 2. The tabs 8a, 8b can be formed by cutting into enclosure 5, for example, U- or similarly shaped tabs. By bending these tabs 8a, 8b inwardly, that is, towards the resonator, the distance between the resonator and the tab is altered, in consequence of which the capacitance between the tab and the resonator and thus the resonance frequency of the resonator, changes. In FIGS. 1 and 2, reference number 1 shows a dielectric filter, reference number 2 shows a dielectric block and reference numbers 3a, 3b show holes formed in the dielectric block, which holes are coated with an electrically conductive material 4, forming the transmission line resonators. The lower surface and side surfaces of dielectric block 2 are also coated with an electrically conductive material, which joins the coating of resonator holes 3a, 3b. The upper surface 9 of the dielectric block is uncoated.

When a current travels in resonator 3a, a TEM wave is generated between the conductive layer surrounding the dielectric block, that is, coating 4 and enclosure 5, and resonator 3a, whereby TEM-modal electric, E, and magnetic, H, fields are formed in the dielectric block, as is shown in FIG. 3, which is a cross-section A-A' of FIG. 2, and in FIG. 4. The resonator acts as a kind of antenna and the component of the magnetic field of the TEM wave generates a modal wave, which oscillates strongly as the resonator 3b of the next stage. The electric and magnetic fields of this modal wave, couple resonators 3a and 3b to each other. In the resonator the orientation of the electrical field of the modal wave is from its lower end to the open upper end and the electrical field of this modal wave is the strongest inside the resonator tube at its upper end. As is shown in FIGS. 3 and 4, the electrical E and magnetic H fields do not radiate outwards from the dielectric block but remain in dielectric block 4 and in resonator tube 3a, 3b because the dielectric block binds the fields fairly strongly within itself owing to the high dielectric coefficient $\epsilon_r$ of the dielectric substance. Because the electrical field that is set up outside the resonator is thus weak, electrode 6a, 6b or tab 8a, 8b, which are positioned above the open end, do not provide a strong coupling or a very great frequency tuning effect.

For tuning the frequency of a resonator according to the prior art, the use of a so-called tuning plug is known, whereby a sleeve of electrically insulating material is disposed inside the resonator tube (3a, 3b in FIG. 2), inside of which sleeve an electrical conductor, for example, electrical wire, of a specified length is disposed, which is grounded at its upper end to the enclosure covering the upper surface of the resonator. In this manner the frequency can be tuned more effectively when the conductor that is connected to the ground plane is introduced into the resonator tube, in which the electrical field is stronger. Frequency tuning tab 8a, 8b and electrode plate 6a, 6b are of a form and size such that they do not fit inside resonator tube 3a, 3b, or bending the tab to make it go inside the resonator tube would at least be a very difficult and precision work stage to carry out if the tab were made to be so small in size that it would fit into the resonator hole.

SUMMARY OF THE INVENTION

In accordance with a first aspect of the present invention there is provided a dielectric resonator comprising:

a dielectric block having a hole extending between opposed surfaces one of which is coated with an electrically conductive material and the other of which is uncoated, the hole having an electrically coated bore providing a transmission line resonator, the bore being wider adjacent the uncoated surface than adjacent the coated surface, and an electrically conductive frequency tuning element grounded at one end and extending towards the hole such that a capacitance is provided between the transmission line resonator and ground.

In accordance with a second aspect of the present invention there is provided a dielectric resonator comprising a dielectric block, which has an upper, and lower surfaces as well as side surfaces and in which a hole has been made, which extends from the upper surface to the lower surface, the hole and lower surface as well as at least part of the side surfaces being coated with an electrically conductive material, at least the upper surface being uncoated, the hole forming a transmission line resonator, and the uncoated surfaces are covered with a lid of an electrically conductive material, whereby the dielectric block is substantially surrounded by an electrically conductive material, characterized in that the resonator hole is composed of two portions, a straight portion that begins from the lower surface of the dielectric block as well as a wider portion that is formed above the straight portion and opens into the upper surface of the dielectric block, both portions being coated with an electrically conductive material and the coating of both portions being united; and a frequency tuning element formed above the hole, the first end of which frequency tuning element is grounded, the other end being at a distance from the surface of the resonator hole, thus forming a capacitance between the ground plane and the upper end of the transmission line resonator.

The invention provides a dielectric resonator whose frequency can be tuned more simply and efficiently than in the above-described solutions according to the prior art. Such a resonator is provided by shaping the upper end of the resonator of the dielectric block and coating it in such a way that the upper end of the resonator is wider than the straight portion of the resonator hole, which begins from the lower end of the dielectric block. It is possible to arrange in this widened upper end of the resonator hole, in which there is a stronger electrical field than outside the hole, a frequency tuning element that tunes the capacitance, a tab which is bent advantageously from the enclosure, which tab can thus be introduced into a strong electrical field, whereby the coupling and frequency tuning is stronger. The widening thus formed can be of any width, depth and shape whatsoever. The point is to bring about the formation at the upper end of the resonator of a portion, covered with an electrically conductive material, which is wider than the resonator hole and forms a juncture with the coating of the resonator hole such that a frequency tuning element can be introduced into a stronger electrical field in the resonator hole.

It is a characteristic feature of the invention that the resonator hole is composed of two portions, a straight portion beginning from the lower surface of the dielectric block and a wider portion that is formed above the straight portion and opens into the upper surface of the dielectric block, both portions being coated with an electrically conductive material and the coating of both portions being united, and above the hole a frequency tuning element is formed, the first end of which is grounded, the other end being at a distance from the surface of the resonator hole, thus forming a capacitance between the ground plane and the upper end of the transmission line resonator.

BRIEF DESCRIPTION OF THE DRAWINGS

The invention is described in the following with reference to the accompanying drawings in which.

DETAILED DESCRIPTION OF THE INVENTION

Figure 1:
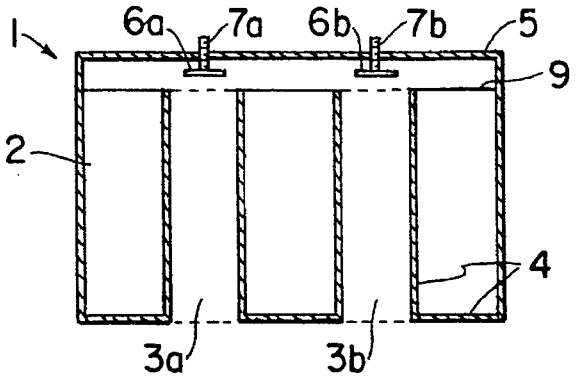
FIG. 1 PRIOR ART
FIG. 1 shows frequency tuning with an electrode plate according to the prior art.
Figure 4:
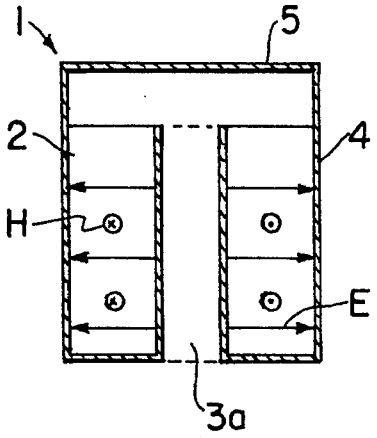
FIG. 4 shows the distribution of the electrical and magnetic field in the dielectric resonator viewed from a different direction than in FIG. 3.
Figure 2:
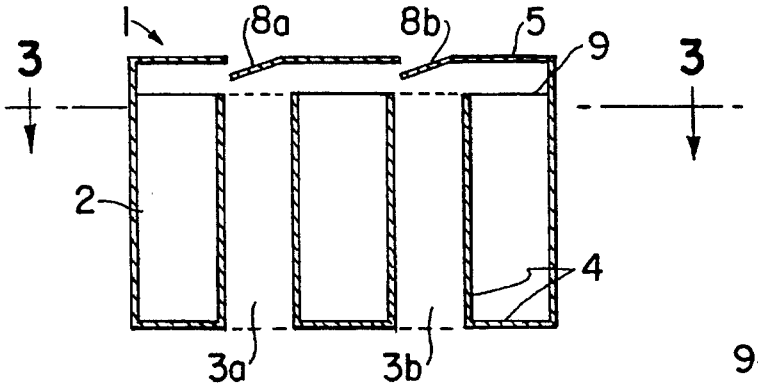
FIG. 2 PRIOR ART
FIG. 2 shows frequency tuning according to the prior art by means of a tab cut out of an enclosure.
Figure 5:
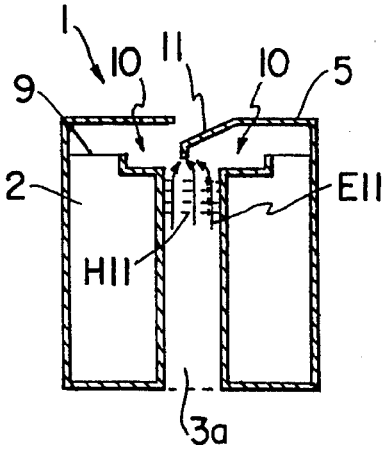
FIG. 5 shows an embodiment according to the invention.
Figure 3:
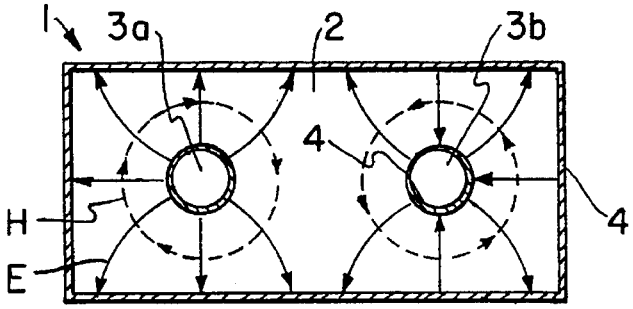
FIG. 3 shows the distribution of the electrical and magnetic fields in a dielectric resonator.

FIG. 5 shows the basic construction of a dielectric resonator 1 that enhances frequency tuning in accordance with the invention. Dielectric resonator 1 comprises dielectric block 2, which has upper 9 and lower surfaces as well as side surfaces and in which a hole 3*a* has been made, which extends from the lower surface to the upper surface. The lower surface and substantially all the side surfaces are coated with an electrically conductive material, for example, by coating or covering with a crust of an electrically conductive material. Upper surface 9 is uncoated and, in addition, one side surface can be left uncoated, in which coupling elements can be arranged for coupling the resonator, as was discussed in connection with the prior art. Finally, also the upper surface and possibly the uncoated side surface are covered with a lid of an electrically conductive material in such a way that the dielectric block is substantially surrounded by an electrically conductive material throughout. In accordance with the invention, upper surface 9 of the dielectric block is formed round resonator hole 3*a*, whereby a wider portion 10 is formed at the upper end of hole 3*a*, this portion being coated with an electrically conductive material that forms a juncture with the coating of the hole, whereby said wider portion 10 forms a part of the transmission line resonator itself. Thanks to this wider portion formed at the upper end, the frequency can be tuned more effectively with a frequency tuning element 11 that is disposed above the resonator hole, for example, with a tab 11 formed in lid 5, which is of an electrically conductive material and covers upper surface 9, as is shown in FIG. 5. The wider portion 10 is not limited to the size shown in FIG. 5 with respect to the length of the resonator nor to the form shown in FIG. 5; instead, it can be shaped in any way whatsoever, as long as it has been coated and its aperture is wider than resonator hole 3*a* so that a frequency tuning element can be introduced inside the aperture for the purpose of tuning the frequency of the resonator.

Because the wider portion 10 of the upper end of the resonator is an extension of resonator hole 3*a*, it also elongates the length of the transmission line resonator without changing the height of the dielectric block. Accordingly, thanks to the wider portion arranged at the upper end of the resonator, the dielectric block can be fabricated to be lower in comparison with dielectric resonators of the prior art, which have a straight resonator hole but lack the wider portion 10 of the upper end according to the invention. Also essential from the standpoint of the invention is the fact that together with the wider upper end of the resonator in accordance with the invention, use is made of a frequency tuning element arranged above the upper end of the resonator, which element is of a size and form enabling it to be inserted through the aperture of said wider portion 10 beneath the upper surface 9 of the dielectric block and inside the wider portion 10 of the resonator hole without touching the coating of resonator hole 3*a* or its wider portion. Accordingly, said frequency tuning element 11 is in the electromagnetic field of the modal wave (modal wave $TEM_{11}$) in the resonator hole, the corresponding electrical field $E_{11}$ being oriented with the resonator hole and travelling from its lower surface to its upper surface, whereby the electrical field becomes denser around frequency tuning element 11. As a consequence of this the magnetic flux becomes thicker and the degree of coupling from frequency tuning element 11 to resonator 3*a* increases, whereby the degree of frequency tuning also increases, thereby providing a greater interval of variation in the frequency tuning.

Figure 7:
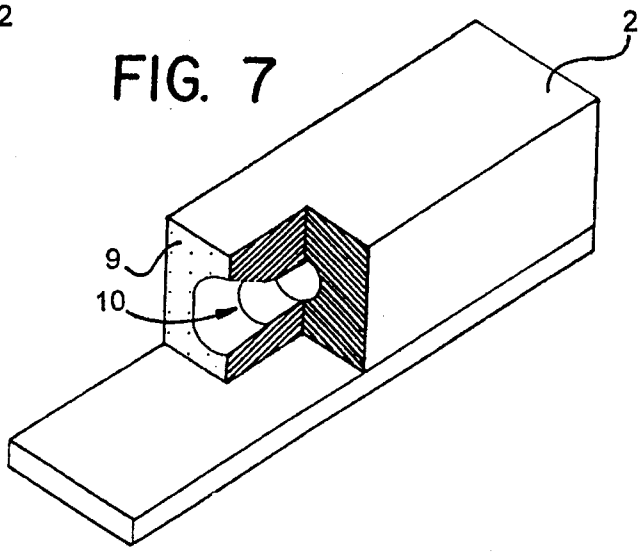
FIG. 7 shows a cross-section of the widening of the resonator hole according to the invention.
Figure 6:
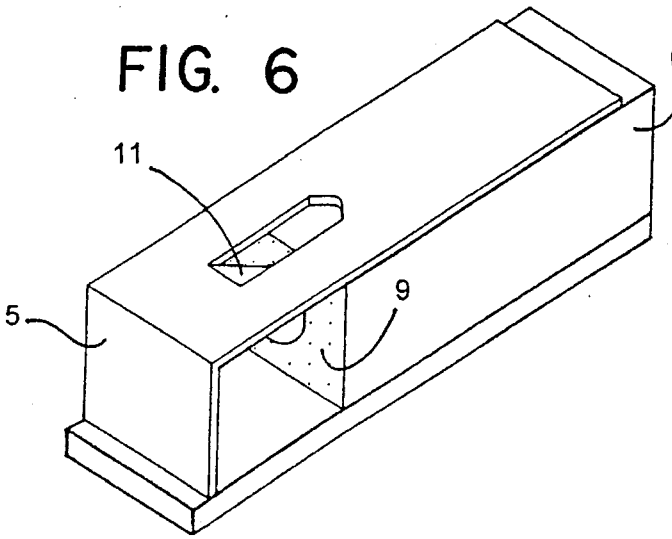
FIG. 6 shows another positioning of the frequency tuning element according to the invention.
Figure 8:
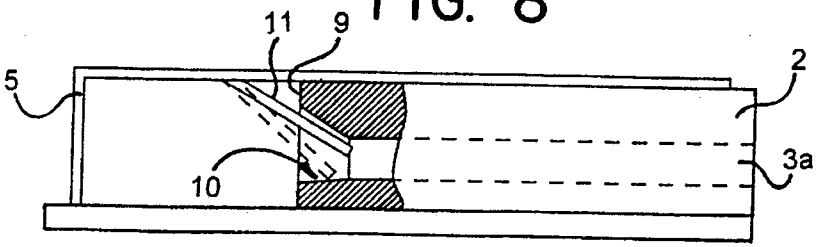
FIG. 8 shows a combination of the widening and frequency tuning element according to the invention and FIG. 9 shows another combination of the widening and frequency tuning element according to the invention.
Figure 9:
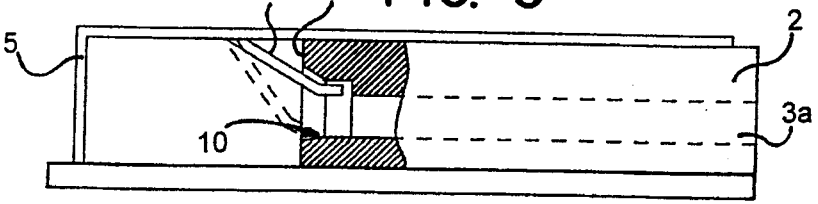

Alternative solutions both in respect of the configuration of the wider upper end 10 and the form and positioning of frequency tuning element 11 are shown in FIGS. 6–9. Frequency tuning element 11 can thus be formed not only in the lid above the resonator hole but also, for example, in the lid covering the side surface of dielectric block 2, as is shown in FIGS. 6, 8 and 9. In addition, frequency tuning element 11 can have a variety of shapes: it can be straight, as is shown in FIG. 8, or its end can be bent at an angle, as is shown in FIG. 9. Its cut-out from the lid is not restricted to any given shape, either, but can be, for example, of a shape shown in FIG. 6 and it can also be U-shaped or rectangular. FIGS. 6–9 illustrate that the upper end 10 of the resonator can be conical and widen steplessly, as is shown in FIG. 8, or it can be stepped, as is shown in FIGS. 7 and 9. In addition, the widening 10 can be disposed in any way whatsoever with respect to the resonator hole: it can widen symmetrically or asymmetrically (according to FIGS. 8 and 9) with respect to resonator hole 3*a*.

In view of the foregoing description it will be evident to a person skilled in the art that various modifications may be made within the scope of the invention.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

What is claimed is:

1. A dielectric resonator comprising:

a dielectric block having opposed surfaces and a hole extending between the opposed surfaces, one of which surfaces is coated with an electrically conductive material and the other of which is uncoated, the hole having an electrically coated bore forming a transmission line resonator capable of generating an electric field therein, the bore having a wider section adjacent the uncoated surface than adjacent the coated surface, and an electrically conductive frequency tuning element grounded at one end and having a structure such that an opposing end is bent into the wider section in the bore of the transmission line resonator so as to frequency tune the dielectric resonator by affecting the field present in the wider section and providing a capacitance between the transmission line resonator and ground.

2. A dielectric resonator according to claim 1, wherein the wider portion of the resonator hole widens smoothly towards the uncoated surface of the dielectric block.

3. A dielectric resonator according to claim 1, wherein the wider portion of the resonator hole widens in a stepped arrangement towards the uncoated surface of the dielectric block.

4. A dielectric resonator according to claim 1, wherein the wider portion of the resonator hole widens symmetrically towards the uncoated surface of the dielectric block along the axis of the resonator hole.

5. A dielectric resonator according to claim 1, wherein the wider portion of the resonator hole widens asymmetrically towards the uncoated surface of the dielectric block along the axis of the resonator hole.

6. A dielectric resonator according to claim 1, further including a lid covering the uncoated surface of the dielectric block wherein the frequency tuning element is formed in the lid as a bendable tab.

7. A dielectric resonator according to claim 1, further including a lid covering a side surface of the dielectric block wherein the frequency tuning element is formed in the lid as a bendable tab.

8. A dielectric resonator comprising:

a dielectric block which has an upper surface and a lower surface and side surfaces said block defining a hole extending from the upper surface to the lower surface, the hole and lower surface as well as at least a portion of the side surfaces being coated with an electrically conductive material, at least a portion of the upper surface adjacent the hole remaining uncoated, the hole forming a transmission line resonator adapted to generate an electric field therein;

a lid formed of an electrically conductive material over the upper surface of the dielectric block, whereby the dielectric block is substantially surrounded by an the electrically conductive material, the resonator hole includes a straight portion extending from the lower surface of the dielectric block and a wider portion that is formed above the straight portion and opens onto the upper surface of the dielectric block under the lid, both the straight and wide portions of the hole being coated with an electrically conductive material; and a frequency tuning element having first and second ends formed above the hole with the first end being grounded and having a structure such that the second end is bent into at least the wide portion of the hole from the surface of the transmission line resonator so as to frequency tune the dielectric resonator by affecting the electric field present in the resonator hole and providing a capacitance between the ground and the transmission line resonator.

9. A dielectric filter comprising:

a first dielectric resonator; and at least one other dielectric resonator including;

(i) a dielectric block having opposed surfaces and a hole extending between the opposed surfaces, one of said surfaces being coated with an electrically conductive material, the hole having an electrically coated bore forming a transmission line resonator capable of generating electric field therein, the bore having a wider section adjacent the uncoated surface than adjacent the coated surface; and (ii) an electrically conductive frequency tuning element grounded at one end and having a structure such that an opposing end is bent into the wider section in the bore of the transmission line resonator so as to frequency tune the dielectric resonator by affecting the electric field therein and providing a capacitance between the transmission line resonator and ground.

* * * * *